United States Patent [19]

Shirey et al.

[11] Patent Number: 5,069,172

[45] Date of Patent: Dec. 3, 1991

[54] NUCLEAR STEAM GENERATOR SLUDGE LANCE METHOD AND APPARATUS

[75] Inventors: Ray A. Shirey, New Stanton; David E. Murray, Greensburg, both of Pa.

[73] Assignee: Westinghouse Electric Corp., Pittsburgh, Pa.

[21] Appl. No.: 590,078

[22] Filed: Sep. 26, 1990

[51] Int. Cl.[5] ..... F22B 37/54; F28G 9/00; F28G 15/00

[52] U.S. Cl. ..... 122/382; 122/392; 134/167 C; 134/172; 165/95

[58] Field of Search ..... 122/282, 392, 381, 391; 165/95; 15/316 R; 134/167 C, 172, 168 C

[56] References Cited

U.S. PATENT DOCUMENTS

| | | |
|---|---|---|
| 4,079,701 | 3/1978 | Hickman et al. . |
| 4,276,856 | 7/1981 | Dent et al. . |
| 4,424,769 | 1/1984 | Charamathieu et al. . |
| 4,445,465 | 5/1984 | Byrd et al. . |
| 4,492,187 | 1/1985 | Hammond . |
| 4,715,324 | 12/1987 | Muller et al. . |
| 4,844,021 | 7/1989 | Stoss . |

*Primary Examiner*—Edward G. Favors

[57] ABSTRACT

A process and system for removing sludge deposits from a tube sheet of a steam generator having at least one handhole provided adjacent the tube sheet is disclosed. The process includes the steps of inserting a suction device through the handhole and into an interior region of the steam generator, inserting a reciprocable fluid injection device supporting structure having a reciprocable carriage positioned thereon through the handhole and into a tube lane, within the steam generator adjacent a first side of a plurality of stay rods positioned in the tube lane, securing the supporting structure to at least one of the stay rods, positioning an end of a reciprocable fluid injection device in the carriage, inserting a peripheral fluid injection device through the handhole and into the tube land adjacent an opposing side of the plurality of stay rods to a position diametrically opposed to the handhole, and reciprocating the reciprocable fluid injection device along the tube land while injecting high pressure fluid towards the tube sheet with the reciprocable fluid injection device, injecting high pressure fluid through the peripheral fluid injection device and drawing dislodged sludge deposits from the interior of the steam generator by the suction device.

31 Claims, 4 Drawing Sheets

NUCLEAR STEAM GENERATOR SLUDGE LANCE METHOD AND APPARATUS

TECHNICAL FIELD OF THE INVENTION

The present invention relates to a process and apparatus for sludge lancing nuclear steam generators to remove sludge deposits from the upper surface of the tube sheet. More particularly, the present invention provides a sludge lance system wherein at no time is the pressure blasts of the high pressure water jets obstructed by any component of the sludge lance system.

BACKGROUND OF THE INVENTION

A typical nuclear steam generator comprises a vertically-oriented shell, a plurality of U-shaped tubes disposed in the shell so as to form a tube bundle, a tubesheet for supporting the tubes at the ends opposite the U-shaped curvature, a dividing plate that cooperates with the tubesheet forming a primary fluid inlet plenum at the one end of the tube bundle and a primary fluid outlet plenum at the other end of the tube bundle, a primary fluid inlet nozzle in fluid communication with the primary fluid inlet plenum, and a primary fluid outlet nozzle in fluid communication with the primary fluid outlet plenum. The steam generator also comprises a wrapper disposed between the tube bundle and the shell to form an annular chamber adjacent the shell and a feedwater ring disposed above the U-shaped curvature end of the tube bundle. The primary fluid having been heated by circulation through the reactor core enters the steam generator through the primary fluid inlet nozzle. From the primary fluid inlet nozzle, the primary fluid is conducted through the primary fluid inlet plenum, through the U-tube bundle, out the primary fluid outlet plenum, through the primary fluid outlet nozzle to the remainder of the reactor coolant system. At the same time, feedwater is introduced to the steam generator through the feedwater ring. The feedwater is conducted down the annular chamber adjacent the shell until the tubesheet near the bottom of the annular chamber causes the feedwater to reverse direction passing in heat transfer relationship with the outside of the U-tubes and up through the inside of the wrapper. While the feedwater is circulating in heat transfer relationship with the tube bundle, heat is transferred from the primary fluid in the tubes to the feedwater surrounding the tubes causing a portion of the feedwater to be converted to steam. The steam then rises and is circulated through typical electrical generating equipment thereby generating electricity in a manner well known in the art.

Since the primary fluid contains radioactive particles and is isolated from the feedwater only by the U-tube walls which may be constructed by Inconel®, the U-tube walls form part of the primary boundary for isolating these radioactive particles. It is, therefore, important that the U-tubes be maintained defect-free so that no breaks will occur in the U-tubes. However, experience has shown that under certain circumstances, the U-tubes may develop leaks therein which allow radioactive particles to contaminate the feedwater, which is a highly undesirable and dangerous result.

There is now thought to be at least two causes of tube leaks in steam generators. One cause of these leaks is considered to be related to the chemical environment of the feedwater side of the tubes. Analysis of the tube samples taken from operating steam generators which have experienced leaks has shown that the leaks were caused by cracks in the tubes resulting from intergranular corrosion. High caustic levels found in the vicinity of the cracks in the tube specimens taken from operating steam generators and the similarity of these cracks to failures produced by caustic under controlled laboratory conditions have identified high caustic levels as the cause of the intergranular corrosion and thus the cause of the tube cracking.

The other cause of tube leaks is thought to be tube thinning. Eddy current tests of the tubes have indicated that the thinning occurs on tubes near the tubesheet at levels corresponding to the levels of sludge that accumulates on the tubesheet. The sludge is mainly from oxides and copper compounds along with traces of other metals that have settled out of the feedwater onto the tubesheet. The level of sludge accumulation may be inferred by eddy current testing with a low frequency signal that is sensitive to the magnetic material in the sludge. The correlation between sludge levels and the tube wall thinning location strongly suggests that the sludge deposits provide a site for concentration of a phosphate solution or other corrosive agents at the tube wall that results in tube thinning.

One method for removing sludge from a steam generator is described in U.S. Pat. No. 4,079,701 entitled "Steam Generator Sludge Removal System", issued Mar. 21, 1978 to Hickman et al. and assigned to the assignee of the present invention. In many nuclear steam generators in service today, there are six-inch diameter hand holes in the shell of the steam generator near the tubesheet that provides access to the tubesheet for removal of the sludge deposits on the tubesheet. With the system of Hickman et al., a fluid flushing stream is continuously maintained from a pair of flushing fluid injection nozzles inserted in one of the hand holes of the steam generator, around the annular space between the lower shell of the steam generator and the tube bundle, to a flushing fluid suction apparatus located at a second hand hole which diametrically opposes the first hand hole. While the fluid flushing stream is continuously maintained, a movable fluid lance is placed in the steam generator and moved along the tube lane to dislodge deposits from between the two brews and move the sludge toward and into the annular space where it is entrained in the continuously flowing flushing fluid stream. U.S. Pat. No. 4,276,856 issued to Dent et al. discloses a sludge lance advancing device used in carrying out the above-described process. However, often the pressure blast out of the high-pressure water jet is obstructed by other components of the sludge lance system.

U.S. Pat. No. 4,445,465 discloses a sludge lancing system which alternately directs the entire fluid flow first to the single movable lance for dislodging the sludge from between the tube rail while moving the sludge lance outwardly to the periphery of the tube bundle and then a stationary flushing fluid injector which directs the entirety of the available fluid about the periphery of the tube to flush the sludge which was previously dislodged by the movable lance toward a suction system. However, again, as with the previously discussed device, the pressure blast of the high-pressure water jet may be obstructed by various components of the sludge lance system. Consequently, the pressure blast of the high-pressure water jet may be diminished, thereby resulting in an insufficient amount of pressure to dislodge the settled sludge material. Various additional nuclear steam generator sludge lancing systems have been developed such as those disclosed in U.S. Pat. Nos. 4,715,324 issued to Muller et al. and 4,844,021 issued to Stoss; however, again, as with the above-mentioned prior devices, the pressure blast of the high-pressure water jet may become obstructed by various components of the sludge lance system resulting in the insufficient dislodging of the sludge material.

Therefore, there is clearly a need for a sludge lancing system which overcomes the aforementioned deficiencies found in the prior devices. More particularly, there is a need for a sludge lancing system wherein the half of the pressure blast generated by the high-pressure water jet is unobstructed by any component of the sludge lance system.

SUMMARY OF THE INVENTION

It is a primary object of the present invention to overcome the shortcomings associated with the abovementioned prior devices.

Another object of the present invention is to provide a sludge lancing system which reliably and efficiently dislodges and removes sludge deposits from the upper surface of a tube sheet of a nuclear steam generator.

Yet another object of the present invention is to provide a sludge lancing system which disperses an unobstructed stream of pressurized fluid towards the sludge deposits to dislodge such deposits s that they may be readily removed by a suction device.

A further object of the present invention is to provide a sludge lancing system which minimizes the down time of the nuclear steam generator and which subjects maintenance personnel to a minimal amount of exposure to a contaminated environment.

Another object of the present invention is to provide a sludge lancing system which removes a substantial portion of the sludge deposits created during the operation of a nuclear steam generator so as to minimize the necessity of carrying out such a maintenance procedure and the subsequent down time of the generator, thereby reducing the overall maintenance and operation costs associated with conversion of nuclear energy into usable electricity.

The above objects as well as others are achieved by providing a process and system for removing sludge deposits from the tube sheet of a nuclear steam generator having at least one handhole provided adjacent the tube sheet. The process includes the steps of inserting a suction device through the handhole and into an interior region of the steam generator, inserting a reciprocable fluid injection device supporting structure having a reciprocable carriage positioned thereon through the handhole and into a tube lane within the steam generator adjacent a first side of a plurality of stay rods positioned in the tube lane, securing the supporting structure to at least one of the stay rods, positioning an end of a reciprocable fluid injection device in the carriage, and inserting a peripheral fluid injection device through the handhole and into the tube lane adjacent an opposing side of the plurality of stay rods to a position diametrically opposed to the handhole with the associated elongated tubing being positioned at a point above the reciprocating fluid injection device. The reciprocable fluid injection device is then reciprocated along the tube lane while injecting high pressure fluid towards the tube sheet and injecting high pressure fluid through the peripheral fluid injection device thereby simultaneously drawing dislodged sludge deposits from the interior of the steam generator by the suction device.

DETAILED DESCRIPTION OF THE PREFERRED EMBODIMENT

In a U-tube type steam generator, a tubesheet supports a bundle of heat transfer U-tubes. During operation, a sludge may form on the tubesheet around the U-tubes causing failure of the tubes. Failure of the tubes results in a release of radioactive particles from the primary reactor coolant into the feedwater of the steam generator. The invention, herein described, is a system for removing the sludge accumulation before it can cause such tube failure.

Figure 1:
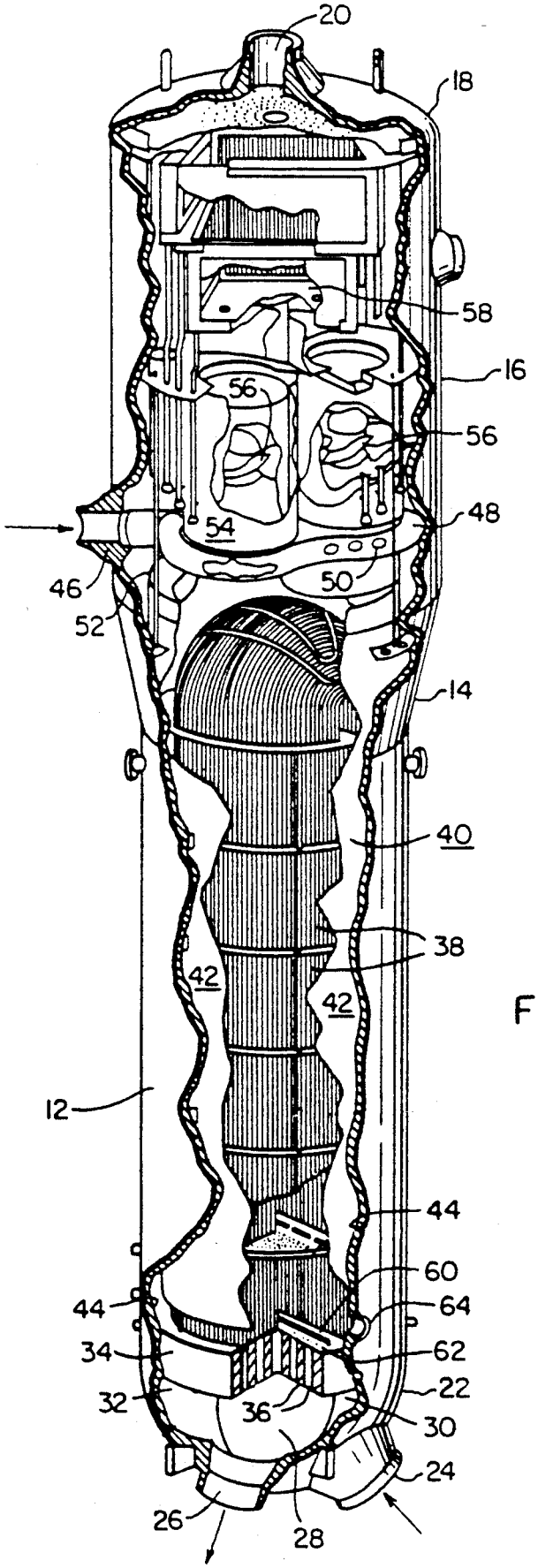
FIG. 1 is a partial cross-sectional view in elevation of a typical steam generator.

Referring to FIG. 1, a nuclear steam generator referred to generally as 10, comprises a lower shell 12 connected to a frustoconical transition shell 14 which connects lower shell 12 to an upper shell 16. A dish-shaped head 18 having a steam nozzle 20 disposed thereon encloses the upper shell 16 while a substantially spherical head 22 having an inlet nozzle 24 and an outlet nozzle 26 disposed thereon encloses the lower shell 12. A dividing plate 28 centrally disposed in the spherical head 22 divides the spherical head 22 into an inlet plenum 30 and an outlet plenum 32. The inlet plenum 30 is in fluid communication with inlet nozzle 24 while outlet plenum 32 is in fluid communication with outlet nozzle 26. A tubesheet 34 having tube holes 36 therein is attached to lower shell 12 and the spherical head 22 so as to isolate the portion of steam generator 10 above tubesheet 34 from the portion below tubesheet 34 in a fluid-tight manner. Tubes 38 which are heat transfer tubes shaped with a U-like curvature are disposed in tube holes 36. Tubes 38 which may number about 7,000 form a tube bundle 40. The dividing plate 28 is attached to tubesheet 34 so that inlet plenum 30 is physically divided from outlet plenum 32. Each tube 38 extends from the tubesheet 34 where one end of each tube 38 is in fluid communication with inlet plenum 30, up into the transition shell 14 where each tube 38 is formed in a U-like configuration, and back down to the tubesheet 34 where the other end of each tube 38 is in fluid communication with the outlet plenum 32. In operation, the reactor coolant having been heated from circulation through the reactor core enters the steam generator 10 through inlet nozzle 24 and flows into the inlet plenum 30. From inlet plenum 30, the reactor coolant flows through tubes 38 in the tubesheet 34, up through the U-shaped curvature of tubes 38, down through tubes 38 and into the outlet plenum 32. From the outlet plenum 32, the reactor coolant is circulated through the remainder of the reactor coolant system in a manner well known in the art.

Again referring to FIG. 1, the tube bundle 40 is encircled by a wrapper 42 which extends from near the tubesheet 34 into the region of transition shell 14. Wrapper 42, together with the lower shell 12 form an annular chamber 44. A secondary fluid or feedwater inlet nozzle 46 is disposed on the upper shell 16 above the tube bundle 40. A feedwater header 48 comprising three loops forming a generally cloverleaf-shaped ring is attached to feedwater inlet nozzle 46. The feedwater header 48 includes a plurality of discharge ports 50 arranged in varying arrays so that a greater number of discharge ports 50 are directed toward annular chamber 44 than are directed otherwise.

During operation, feedwater enters the steam generator 10 through the feedwater inlet nozzle 46, flows through and out of the feedwater header 48 through discharge ports 50. The greater portion of the feedwater exiting discharge ports 50 flows down annular chamber 44 until the feedwater contacts the tubesheet 34. Once reaching the bottom of the annular chamber 44 near the tubesheet 34, the feedwater is directed inwardly around the tubes 38 of the tube bundle 40 where the feedwater passes in heat transfer relationship with the tubes 38. The hot reactor coolant in tubes 38 transfers heat through tubes 38 to the feedwater thereby heating the feedwater. The heated feedwater then rises by natural circulation up through the tube bundle 40. In its travel around tube bundle 40, the feedwater continues to be heated until steam is produced in a manner well known in the art.

Referring now to the upper portion of FIG. 1, the wrapper 42 has an upper cover or wrapper head 52 disposed thereon above the tube bundle 40. disposed on the wrapper head 52 are sleeves 54 which are in fluid communication with the steam produced near the tube bundle 40 and have centrifugal swirl vanes 56 disposed therein. Disposed above sleeves 54 is a moisture separator 58 which may be a chevron moisture separator. The steam that is produced near the tube bundle 40 rises through the sleeves 54 where the centrifugal swirl vanes 56 cause some of the moisture in the steam to be removed. From sleeves 54, the steam continues to rise through the moisture separator 58 where more moisture is removed therefrom. Eventually, the steam rises through steam nozzle 20 from where it is conducted through common machinery to produce electricity; again, all in a manner well known in the art.

Referring again to the lower portion of FIG. 1, due to the curvature of tubes 38, a straight line section of tubesheet 34 is without tubes therein. This straight line section is referred to as a tube lane 60. In conjunction with the tube lane 60, two inspection ports 62 (only one is shown) which may be two inches in diameter are provided diametrically opposite each other and in colinear alignment with the tube lane 60. Two additional inspection ports 62 may be located on the lower shell 12 at 90° to tube lane 60. The inspection ports 62 allow limited access to the tubesheet 34 area. In addition to the inspection ports 62, six inch diameter hand holes 64 are also provided.

Experience has shown that during steam generator operation, sludge may form on the tubesheet 34 around the tubes 38. The sludge which usually comprises iron oxides, copper compounds, and other metals is formed from these materials settling out of the feedwater onto the tubesheet 34. As mentioned previously, the sludge produces defects in the tubes 38 which allow radioactive particles in the reactor coolant contained in tubes 38 to leak out into the feedwater and steam of the steam generator. Such an occurrence is highly undesirable.

Figure 2:
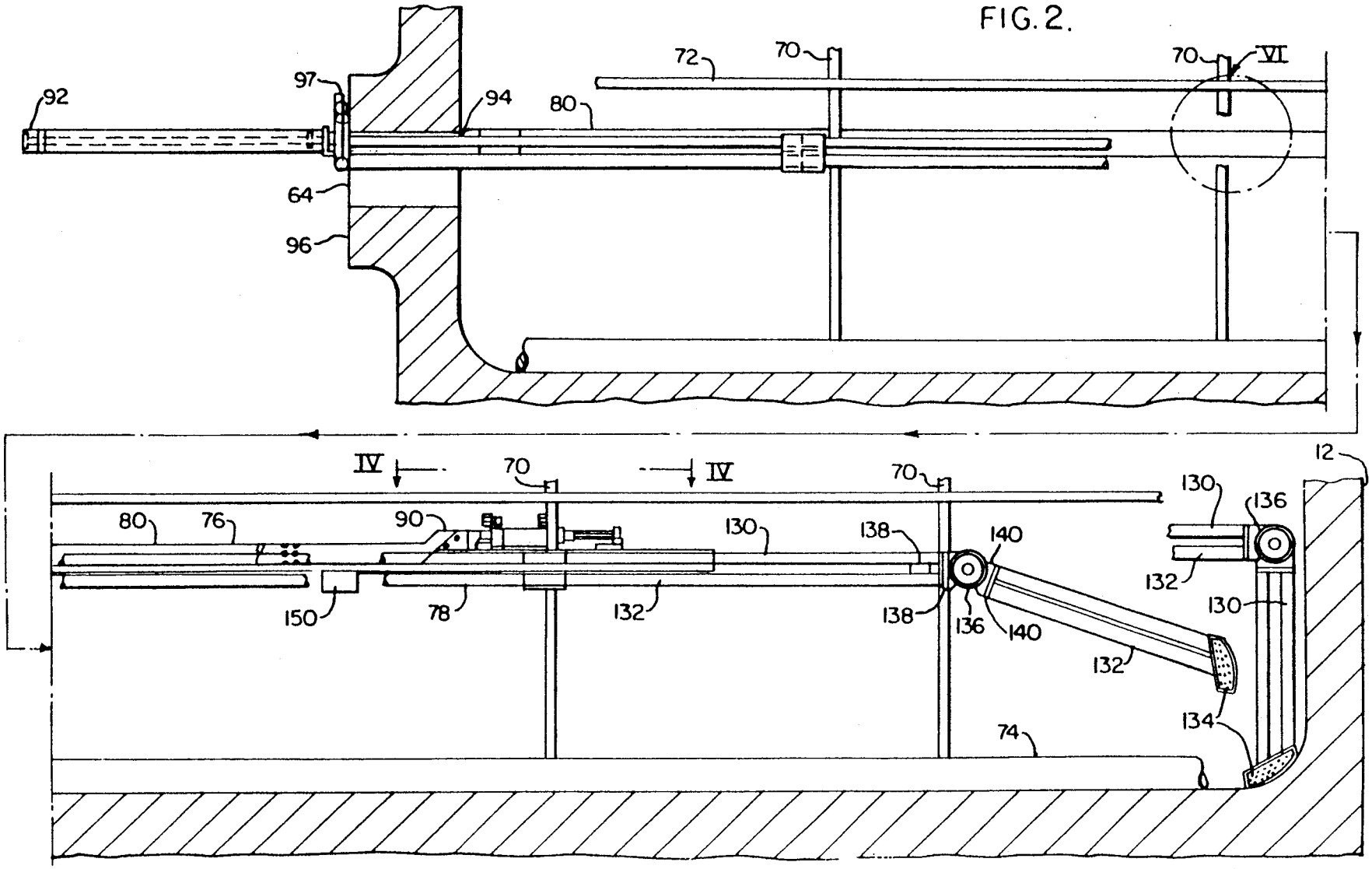
FIG. 2 is an elevational view of the sludge lance system in accordance with the present invention positioned within the nuclear steam generator of FIG. 1.

Referring now to FIG. 2, the nuclear steam generator sludge lancing system of the present invention is illustrated. For the purpose of clarity, the reciprocable sludge lance is not illustrated and may be of the type set forth in U.S. Pat. No. 4,276,856 referred to above or any other type of high pressure spray nozzle. FIG. 2 illustrates the lower portion of the lower shell 12 just above the tubesheet 34. The cross-section view of FIG. 2 is taken through the tube lane 60, and, consequently, there are no tube holes 36 or tubes 38 illustrated. A conventional nuclear steam generator includes a plurality of stay rods 70 and support plates 72 which aid in supporting the tubes 38 of the tube bundle. Also disposed within the lower shell 12 of the nuclear steam generator is a conventional suction header 74 which is initially inserted into the hand hole as is conventional with previous sludge lance operations.

Figure 6:
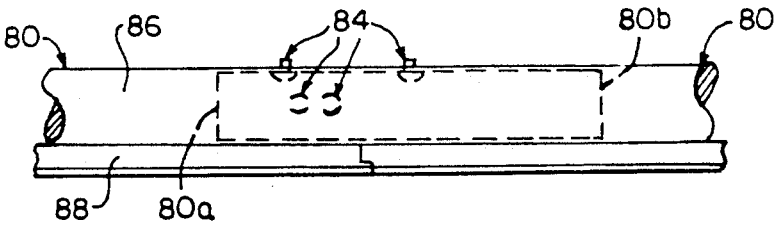
FIG. 6 is an expanded view of the encircled area VI of FIG. 2 illustrating the interconnection of the sections forming a rail assembly in accordance with the present invention.

The sludge lance system of the present invention consists primarily of two components, the first being an overhead rail support and delivery assembly 76 and the second being a peripheral flow header assembly 78. The overhead rail support and delivery assembly 76 includes a plurality of rail sections 80 which are interconnected with one another by connections 82 in order to extend the appropriate length into the nuclear steam generator. The connection 82 is best illustrated in FIG. 6 and includes a plurality of detents 84 which act with one another to maintain the telescopic members 80*a* and 80*b* interconnected when the members are inserted within one another. As can be seen from FIG. 6, the overhead rail assembly is constructed to include an upper tubular extent 86 and a lower inverted T extent 88. The particular construction of the overhead rail assembly will be discussed in greater detail hereinbelow.

The leading section of the overhead rail support and delivery assembly includes a gripper device 90 which grips a respect of one of the stay rods 70 within the nuclear steam generator. With the present invention, the gripper assembly 90 grips the third stay rod within the nuclear steam generator. Once the appropriate number of sections 80 are interconnected and attached to the handhole handling tool 92 which includes a mounting piece 94 which is formed to receive the periphery of the handhole 64, the overhead rail support and delivery assembly 76 is inserted on a first side of the stay rods 70 and into the tube lane 60. The overhead rail support and delivery assembly 76 is inserted into the tube lane 60 until the gripper assembly 90 is positioned along side a predetermined stay rod. Once in this position, the handhole handling tool 92 is secured to the handhole flange 96. The handhole handling tool 92 may be secured to the handhole flange 96 by a latching mechanism which latches on to a flange bolt already positioned in the hand hole flange 96. The digital end of the overhead rail support and delivery assembly is then adjusted upwardly or downwardly in order to position the overhead rail assembly parallel to the support plate 72. This may be accomplished by either providing a feeler rod at the end of the overhead rail support assembly which when in contact with the support plate 72 positions the overhead rail assembly parallel to the support plate 72 or a leveling indicator within the handhole handling tool 92. Once the overhead rail assembly 76 is positioned parallel to the support plate 72, the gripper assembly 90 is extended in order to grip the predetermined stay rod 70. The gripping assembly 90 is best illustrated in FIGS. 3–5.

Figure 3:
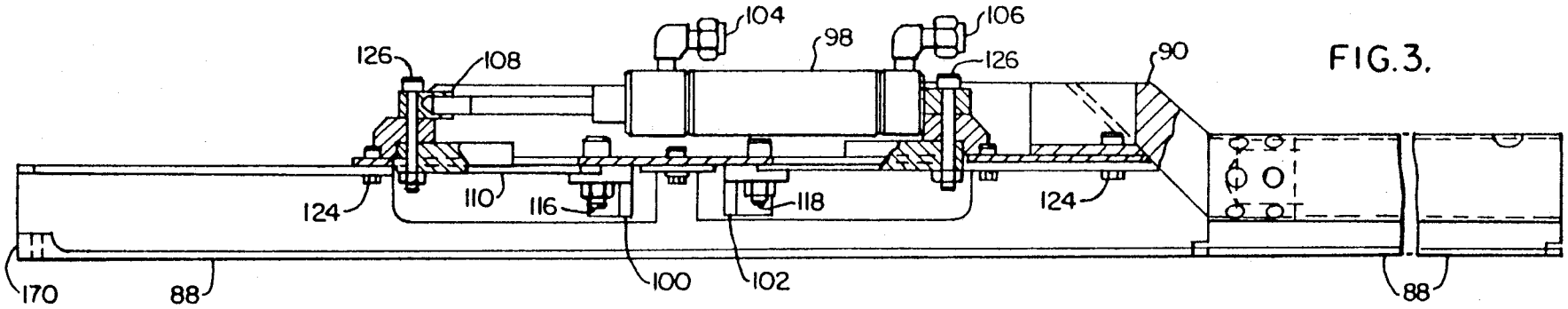
FIG. 3 is an expanded view of the gripping mechanism of the sludge lance system in accordance with the present invention.
Figure 4:
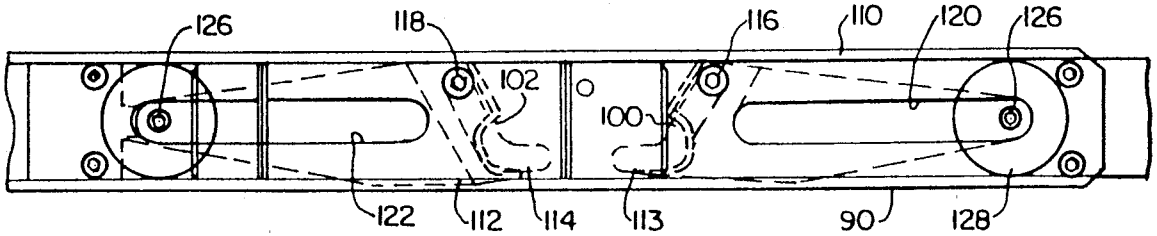
FIG. 4 is a top view of the gripping mechanism of FIG. 3 shown in its retracted condition.
Figure 5:
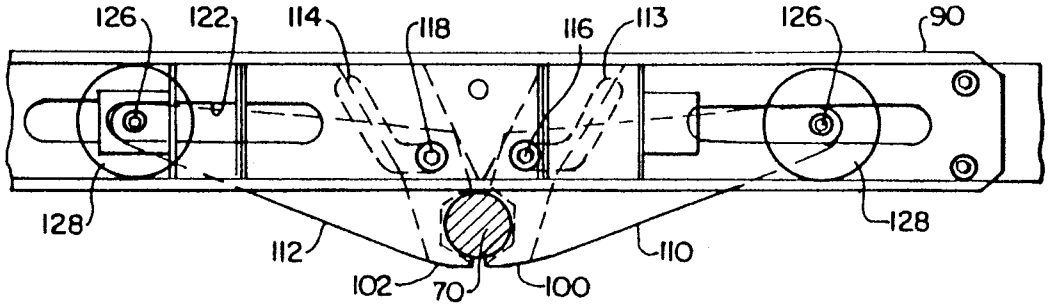
FIG. 5 is a top view of the gripping device of FIG. 3 shown in its extended condition.

Referring now to FIGS. 3–5, the gripper assembly 90 will be described in greater detail. It should be noted that with the preferred embodiment, a pneumatically actuated clamp is provided; however, an electromagnetic or hydraulic gripper assembly may be readily adapted to the present invention.

As mentioned previously, the gripper assembly 90 is a pneumatically actuated gripper assembly and includes the pneumatic master cylinder 98 for selectively retracting and extending the gripper jaws 100 and 102. The cylinder 98 includes leads 104, 106 which supply pneumatic fluid to the cylinder 98. In response to a change in the pressure being supplied to the cylinder 98, the piston rod 108 will retract thereby drawing the slide mechanisms 110 and 112 toward one another. In doing so, the jaws 100 and 102 will be displaced outwardly towards the stay rod. This is carried out by providing cam slots 112 and 114 which each receive a respective cam follower 116 and 118 which as can be seen from FIGS. 4 and 5 push the jaws 100 and 102 outwardly and towards one another upon retraction of the piston rod 108. The slides 110 and 112 are readily received within slots 120 and 122 respectively which allow for the reciprocation of the jaw members 100 and 102. The cylinder 98 is secured to the rail assembly by fixtures 124 above the inverted T rail 88. The slides 110 and 112 are slidably positioned above the inverted rail 88 by bolts 126 which extend through a friction-reducing disc 128 which allows the slides 110 and 112 to reciprocate in response to a change in the pressure being supplied to the cylinder 98.

Returning again to FIG. 2, once the overhead rail support assembly is secured within the tube lane 60 of the nuclear steam generator, the peripheral flow header assembly 78 is inserted into the tube lane 60 parallel to the overhead rail assembly on the opposite side of the stay rods 70.

The peripheral flow header assembly 78 includes upper and lower fluid supply tubes 130 and 132. The fluid supply tubes supply a pressurized fluid, such as water, to a nozzle 134 which shoots jets of water out opposite sides thereof such that the water travels along the inner periphery of the lower section 12 of the nuclear steam generator. The peripheral flow header assembly 78 includes a knee joint 136 which allows the peripheral flow header assembly 78 to pivot at a predetermined point along its length at an angle of approximately 90 degrees so as to properly position the peripheral flow header assembly within the nuclear steam generator. The knee joint includes a fluidic connection for both the upper and lower fluid tubes such that pressurized fluid may continuously flow through the knee joint. The knee joint includes a pair of inlets 138 and a pair of outlets 140. This allows the peripheral flow header assembly 78 to be properly positioned within the nuclear steam generator and further allow an unobstructed flow of fluid to the nozzle 134. The peripheral flow header assembly 78 is inserted through the handhole 64 in a slightly bent condition as is shown by the solid lines in FIG. 2. When the nozzle 134 contacts the opposing inside surface of the lower shell 12 of the nuclear steam generator, the operator will continue to insert the peripheral header assembly 78 such that the nozzle 134 contacts and slides down the inner surface of the lower shell 12 of the nuclear steam generator and rest on an upper surface of the tubesheet 34. In doing so, the peripheral flow header assembly 78 will pivot at the knee joint 136 to a position shown in the hidden lines in FIG. 2. The knee joint thus bends such that the tubes which enter and exit the knee joint 136 are at approximately right angles to one another.

A support clamp (not shown) is then attached to the end of the peripheral flow header assembly 78 which extends through the hand hole 64 and by tightening the support clamp on the tubes 130, 132 of the peripheral flow header assembly 78, the nozzle 134 and the knee joint 136 are pressed against the inside diameter of the lower shell 12 of the nuclear steam generator. By pressing the nozzle 134 and knee joint 136 against the inner diameter of the lower shell 12, the entire horizontal extent of the tubes 130, 132 of the peripheral flow header assembly are caused to bend upwardly approximately two inches which positions the tubes 130, 132 above the inverted T rail 88 of the overhead rail assembly 76. The significance of the particular positioning of the tubes 130, 132 will be explained in greater detail hereinbelow.

Figure 7:
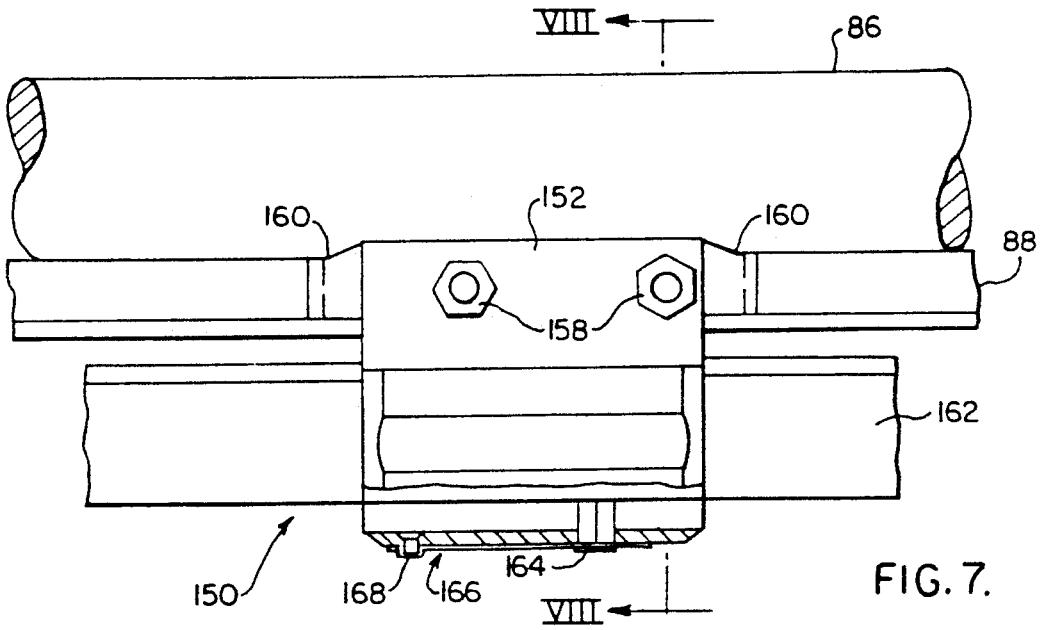
FIG. 7 is an expanded elevational view of the carriage assembly mounted on a portion of the rail assembly in accordance with the present invention.
Figure 8:
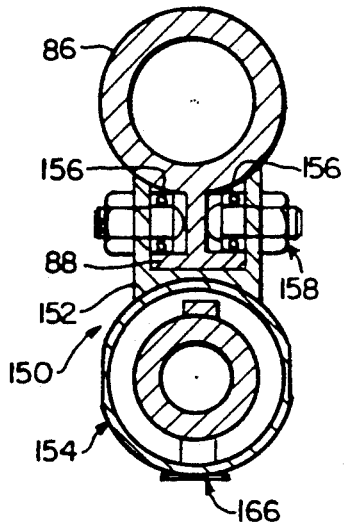
FIG. 8 is a cross-sectional view taken along line VIII—VIII of FIG. 7.

Also illustrated in FIG. 2 is a carriage assembly 150 which is positioned to travel along the inverted T rail 88 in response to the extension and retraction of a sludge lance into and out of the tube lane 60 of the nuclear steam generator. The particular structure of the carriage assembly is best illustrated in FIGS. 7 and 8. As can be seen from FIG. 7, the carriage assembly includes an upper mounting section 152 and a lower sludge lance receiving section 154. As can be seen from FIG. 8, the mounting section 152 includes a plurality of bearings 156 which are adapted to be received by and roll along the upper horizontal extent of the inverted T rail 88. The roller bearings 156 are secured to the mounting section 152 by a fastening means 158 which is preferably of the nut-and-bolt type. Flanges 160 are also provided on the leading and trailing ends of the carriage assembly to assure that any debris which may accumulate on the surface of the inverted T rail 88 which would jeopardize the smooth reciprocation of the carriage assembly is removed before reaching the bearings 156.

The receiving section 154 of the carriage assembly is cylindrical in nature and receives the extended portion of the sludge lance tool 162 therein. A button 164 which is spring biased upwardly against the sludge lance tool 162 by a leaf spring 166 applies a pressure against the lower surface of the sludge lance tool such that when the sludge lance tool is extended and retracted into and out of the nuclear steam generator, the carriage assembly will be likewise reciprocated along therewith. The leaf spring 166 is fixed at one end to the cylindrical receiving 154 section of the carriage assembly 150 by a rivet or similar fixing means 168. Thus, the carriage assembly 150 will support the distal end of the sludge lance tool 162 through a majority of its travel into and out of the nuclear steam generator. The particular operation of the carriage assembly will be described in greater detail hereinbelow.

The operation of the sludge lancing system, in accordance with the present invention, is carried out in the following manner. Initially, the overhead rail assembly is inserted into the lower shell 12 of the nuclear steam generator 10 such that the distal end of the overhead rail assembly 76 extends approximately 12 inches beyond the third stay rod 70 with the gripper assembly 90 being positioned adjacent the third stay rod 70. The overhead rail assembly 76 is then fixed at its proximal end to the flange of the hand hole 64 and adjusted such that the overhead rail assembly 76 extends substantially parallel to the lowermost support plate 72 of the nuclear steam generator 10. Once in this condition, the gripper assembly 90 is actuated such that gripper jaws 100 and 102 securely grasp the third stay rod 70 and fix the overhead rail assembly 76 in its appropriate position. It should be noted that the carriage assembly 150 is to be initially mounted onto the inverted T rail 88 of the overhead rail assembly 76 and positioned adjacent the proximal end of the overhead rail assembly 76.

The peripheral flow header assembly 78 having a knee joint positioned at a predetermined point along the length thereof is inserted in a slightly bent condition through the hand hole 64 of the nuclear steam generator 10. The insertion of the peripheral flow mounted assembly 78 is continued until the nozzle 134 headed on the distal end of the peripheral flow header assembly 78 contacts the inner wall of the lower shell 12 of the nuclear steam generator 10. The operator then continues the insertion of the peripheral header assembly until the knee joint abuts the inside wall of the lower shell 12, thus positioning the tubes 130, 132 which enter and exist the knee joint at approximately right angles to one another. Once in this position, the tubes which extend from the proximal end of the peripheral flow header assembly 78 are clamped by a support clamp 97. When the support clamp 97 is tightened, the horizontal extent of the tubes 130 and 132 of the peripheral flow header assembly 78 are caused to bend upwardly a distance of approximately two inches which thus positions the tubes 131 and 132 of the peripheral flow header assembly above the carriage assembly 150. A sludge lance is then positioned within the receiving section 154 of the carriage assembly 150 and extended into the tube lane 60 of the nuclear steam generator 10. The carriage assembly 150 frictionally engages the distal end of the sludge lance tool 162 and thus is reciprocated along the inverted T rail 88 in response to the movement of the sludge lance tool 162. The distal end of the sludge lance tool is thus carried along the overhead rail assembly 76 by the carriage assembly 150 until the carriage assembly reaches a stop 170 at the end of the overhead rail assembly 76. At this point, the operator continues to insert the sludge lance tool which will then slide through the carriage assembly for the remaining approximately 40 inches of travel until the full extent of the sludge lance tool is extended into the steam generator. Once the sludge lance 162 has reached its furthest extent, it is then retracted through the handhole 64 and is supported by the carriage assembly 150 during its retraction. It is to be noted that during the complete insertion and retraction of the sludge lance tool 162 into and out of the nuclear steam generator, there are no parts of the sludge lance system which would obstruct the flow of pressurized fluid through the nozzle of the sludge lance tool 162 because the sludge lance tool 162 is supported by the overhead rail assembly 76 and the peripheral flow header assembly 78 is positioned at a point above the sludge lance tool 162. Therefore, the sludge lance tool 162 can effectively remove the sludge deposits from the surface of the tubesheet without obstruction from the remaining components of the sludge lancing system.

While the present invention has been described with reference to a preferred embodiment, it will be appreciated by those skilled in the art that the invention may be practiced otherwise and as specifically described herein without departing from the spirit and scope of the invention. It is, therefore, to be understood that the spirit and scope of the invention be limited only by the appended claims.

What is claimed is:

1. A sludge lancing system for removing sludge deposits from an interior region of a steam generator comprising:

a peripheral fluid injection means for injecting a fluid at a high pressure about a periphery of the steam generator, said peripheral fluid injection means comprising at least one elongated fluid conduit, at least one injection nozzle and a joint positioned at a predetermined point along said elongated fluid conduit for permitting said peripheral fluid injection means to bend to a predetermined angle at said joint within the steam generator;

a reciprocable fluid injection means for injecting a fluid at a high pressure toward the sludge deposits and dislodging the sludge deposits; and a supporting means positioned within the interior of the steam generator for supporting said reciprocable fluid injection means throughout the reciprocation of said reciprocable fluid injection means.

2. The sludge lancing system as defined in claim 1, wherein said sludge lancing system is insertable into the interior of the steam generator through a handhole provided in the steam generator.

3. The sludge lancing system as defined in claim 1, wherein said injection nozzle is provided on a distal end of said peripheral fluid injection means, and said predetermined point is spaced a distance from said injection nozzle greater than the distance from a bottom surface of said steam generator to said reciprocable injection means.

4. The sludge lancing system as defined in claim 1, wherein said supporting means includes an overhead rail assembly, said overhead rail assembly being secured at its proximal end to a housing of the steam generator and at an intermediate position between its proximal end and distal end to at least one of a plurality of stay rods positioned within said steam generator.

5. The sludge lancing system as defined in claim 4, further comprising a carriage means supported by and slidable along said overhead rail assembly, said carriage means comprising a receiving means extending below said overhead rail assembly for receiving and supporting said reciprocable fluid injection means.

6. The sludge lancing system as defined in claim 5, wherein said carriage means frictionally engages said reciprocable injection means and reciprocates therewith in response to the reciprocation of said reciprocable fluid injection means.

7. The sludge lancing system as defined in claim 6, further comprising a stop means positioned at the distal end of said overhead rail assembly for stopping said carriage, wherein said reciprocable fluid injection means slides with respect to said carriage assembly when said reciprocable fluid injection means is extended beyond said stop means.

8. A sludge lancing system for removing sludge deposits from an interior region of a steam generator comprising:

a reciprocable fluid injection means for injecting a fluid at a high pressure toward the sludge deposits and dislodging the sludge deposits; and a supporting means including at least one rail assembly positioned within the interior of the steam generator for supporting said reciprocable fluid injection means throughout the reciprocation of said reciprocable fluid injection means, said rail assembly being secured at its proximal end to a housing of the steam generator and at an intermediate position between its proximal end and distal end to at least one of a plurality of stay rods positioned within said steam generator.

9. The sludge lancing system as defined in claim 8, further comprising a peripheral fluid injection means for injecting a fluid at a high pressure about a periphery of the steam generator.

10. The sludge lancing system as defined in claim 9, wherein said sludge lancing system is insertable into an the interior of the steam generator through a handhole provided in the steam generator.

11. The sludge lancing system as defined in claim 10, wherein said peripheral fluid injection means comprises at least one elongated fluid conduit, at least one injection nozzle and a joint positioned at a predetermined point along said elongated fluid conduit for permitting said peripheral fluid injection means to bend to a predetermined angle at said joint within the steam generator.

12. The sludge lancing system as defined in claim 11, wherein said injection nozzle is provided on a distal end of said peripheral fluid injection means, and said predetermined point is spaced a distance from said injection nozzle greater than the distance from a bottom surface of said steam generator to said reciprocable injection means.

13. The sludge lancing system as defined in claim 8, wherein said rail assembly is an overhead rail assembly.

14. The sludge lancing system as defined in claim 13, further comprising a carriage means supported by and slidable along said overhead rail assembly, said carriage means comprising a receiving means extending below said overhead rail assembly for receiving and supporting said reciprocable fluid injection means.

15. The sludge lancing system as defined in claim 14, wherein said carriage means frictionally engages said reciprocable injection means and reciprocates therewith in response to the reciprocation of said reciprocable fluid injection means.

16. The sludge lancing system as defined in claim 15, further comprising a stop means positioned at the distal end of said overhead rail assembly for stopping said carriage, wherein said reciprocable fluid injection means slides with respect to said carriage assembly when said reciprocable fluid injection means is extended beyond said stop means.

17. A process for removing sludge deposits from a tube sheet of a steam generator having at least one handhole provided adjacent the tube sheet, said process comprising:

inserting a suction means through the handhole and into an interior region of the steam generator;

inserting a sludge lance supporting means having a reciprocable carriage positioned thereon through the handhole and into a tube lane within the steam generator adjacent a first side of a plurality of stay rods positioned in the tube lane, securing said supporting means to at least one of the stay rods, positioning an end of a fluid injection means in said carriage, and reciprocating said fluid injection means along the tube lane while injecting high pressure fluid towards the tube sheet with said fluid injection means and drawing dislodged sludge deposits from the interior of the steam generator by said suction means.

18. The process as defined in claim 17, further including the step of inserting a peripheral fluid injection means through the handhole and into the tube lane adjacent an opposing side of the plurality of stay rods to a position diametrically opposed to the handhole, and injecting high pressure fluid through said peripheral fluid injection means.

19. The process as defined in claim 18, wherein said peripheral fluid injection means comprises at least one joint positioned at a predetermined point along an elongated portion of said peripheral fluid injection means, with said step of inserting said peripheral fluid injection means including inserting said peripheral fluid injection means through the handhole in a slightly bent condition until a distal end of said peripheral fluid injection means contacts the diametrically opposed side wall of the steam generator, and bending said peripheral fluid injection means at said joint to a predetermined angle.

20. The process as defined in claim 19, wherein an injection nozzle is provided on a distal end of said peripheral fluid injection means, and said predetermined point is spaced a distance from said injection nozzle greater than the distance from the tube sheet of said steam generator to said reciprocable injection means so that an elongated portion of said peripheral fluid injection means does not obstruct the discharge of fluid from said reciprocable fluid injection means.

21. The process as defined in claim 17, wherein said supporting means includes an overhead rail assembly, with said step of securing said overhead rail assembly including securing its proximal end to a periphery of said handhole and an intermediate point between its proximal end and distal end to at least one of a plurality of stay rods positioned within said steam generator.

22. The process as defined in claim 21, further comprising a carriage means supported by and slidable along said overhead rail assembly, said carriage means comprising a receiving means extending below said overhead rail assembly for receiving and supporting said reciprocable fluid injection means.

23. The process as defined in claim 22, wherein said carriage means frictionally engages said reciprocable fluid injection means and reciprocates therewith in response to the reciprocation of said reciprocable fluid injection means.

24. The process as defined in claim 23, further comprising a stop means positioned at the distal end of said overhead rail assembly for stopping said carriage, wherein said reciprocable fluid injection means slides with respect to said carriage assembly when said reciprocable fluid injection means is extended beyond said stop means.

25. A process for removing sludge deposits from a tube sheet of a steam generator having at least one handhole provided adjacent the tube sheet, said process comprising:

inserting a suction means through the handhole and into an interior region of the steam generator;

inserting a sludge lance supporting means having a reciprocable carriage positioned thereon through the handhole and into a tube lane within the steam generator adjacent a first side of a plurality of stay rods positioned in the tube lane, securing said supporting means to at least one of the stay rods, inserting a peripheral fluid injection means through the handhole and into the tube lane adjacent an opposing side of the plurality of stay rods to a position diametrically opposed to the handhole;

positioning an end of a reciprocable fluid injection means in said carriage, and reciprocating said reciprocable fluid injection means along the tube lane while injecting high pressure fluid towards the tube sheet with said fluid injection means, injecting high pressure fluid through said peripheral fluid injection means and drawing dislodged sludge deposits from the interior of the steam generator by said suction means.

26. The process as defined in claim 25, wherein said peripheral fluid injection means comprises at least one joint positioned at a predetermined point along an elongated portion of said peripheral fluid injection means, with said step of inserting said peripheral fluid injection means including inserting said peripheral fluid injection means through the handhole in a slightly bent condition until a distal end of said peripheral fluid injection means contacts the diametrically opposed side wall of the steam generator, and bending said peripheral fluid injection means at said joint to a predetermined angle.

27. The process as defined in claim 26, wherein an injection nozzle is provided on a distal end of said peripheral fluid injection means, and said predetermined point is spaced a distance from said injection nozzle greater than the distance from the tube sheet of said steam generator to said reciprocable injection means so that an elongated portion of said peripheral fluid injection means does not obstruct the discharge of fluid from said reciprocable fluid injection means.

28. The process as defined in claim 25, wherein said supporting means includes an overhead rail assembly, with said step of securing said overhead rail assembly including securing its proximal end to a periphery of said handhole and an intermediate point between its proximal end and distal end to at least one of a plurality of stay rods positioned within said steam generator.

29. The process as defined in claim 28, further comprising a carriage means supported by and slidable along said overhead rail assembly, said carriage means comprising a receiving means extending below said overhead rail assembly for receiving and supporting said reciprocable fluid injection means.

30. The process as defined in claim 29, wherein said carriage means frictionally engages said reciprocable fluid injection means and reciprocates therewith in response to the reciprocation of said reciprocable fluid injection means.

31. The process as defined in claim 30, further comprising a stop means positioned at the distal end of said overhead rail assembly for stopping said carriage, wherein said reciprocable fluid injection means slides with respect to said carriage assembly when said reciprocable fluid injection means is extended beyond said stop means.

* * * * *